US008840225B2

(12) United States Patent
Shimomura et al.

(10) Patent No.: US 8,840,225 B2
(45) Date of Patent: Sep. 23, 2014

(54) LIQUID EJECTION HEAD AND RECORDING APPARATUS INCLUDING THE SAME

(75) Inventors: Masako Shimomura, Yokohama (JP); Shigeki Fukui, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 407 days.

(21) Appl. No.: 12/639,602

(22) Filed: Dec. 16, 2009

(65) Prior Publication Data

US 2010/0156994 A1 Jun. 24, 2010

(30) Foreign Application Priority Data

Dec. 19, 2008 (JP) ..... 2008-324175

(51) Int. Cl.
*B41J 2/14* (2006.01)
*B41J 2/16* (2006.01)
*B41J 2/175* (2006.01)

(52) U.S. Cl.
CPC ..... *B41J 2/1753* (2013.01); *B41J 2/1752* (2013.01)
USPC ..... 347/50

(58) Field of Classification Search
USPC ..... 347/50; 174/250
See application file for complete search history.

(56) References Cited

U.S. PATENT DOCUMENTS

| | | | | |
|---|---|---|---|---|
| 5,189,787 | A | 3/1993 | Reed | |
| 6,053,598 | A * | 4/2000 | Inpyn | 347/49 |
| 6,626,518 | B2 | 9/2003 | Choy | |
| 2007/0139469 | A1 * | 6/2007 | Yasuda et al. | 347/42 |
| 2007/0139480 | A1 | 6/2007 | Yamaguchi | |
| 2008/0143788 | A1 * | 6/2008 | Toge et al. | 347/50 |
| 2008/0316272 | A1 * | 12/2008 | Goto | 347/50 |
| 2010/0103223 | A1 * | 4/2010 | Yamada | 347/50 |

FOREIGN PATENT DOCUMENTS

| | | | |
|---|---|---|---|
| JP | 11-138814 | A | 5/1999 |
| JP | 2002-254661 | | 9/2002 |
| JP | 2005-506917 | | 3/2005 |
| JP | 2005-116300 | A | 4/2005 |
| JP | 2006-289894 | A | 10/2006 |
| JP | 2007-190907 | | 8/2007 |

* cited by examiner

*Primary Examiner* — Stephen Meier
*Assistant Examiner* — Renee I Wilson
(74) *Attorney, Agent, or Firm* — Canon USA Inc IP Division

(57) ABSTRACT

A liquid ejection head includes a housing having a first outer surface; a liquid ejection substrate disposed at a first portion of the first outer surface and having ejection ports for ejecting liquid; and a wiring member disposed on a second portion of the first outer surface so as to be next to the liquid ejection substrate and electrically connected to the liquid ejection substrate. The ejection ports are covered by a cap that is in contact with the wiring member and a portion, except the second portion, of the first outer surface around the liquid ejection substrate; and the second portion is recessed relative to the portion, except the second portion, of the first outer surface around the liquid ejection substrate.

14 Claims, 8 Drawing Sheets

LIQUID EJECTION HEAD AND RECORDING APPARATUS INCLUDING THE SAME

BACKGROUND OF THE INVENTION

1. Field of the Invention

The present invention relates to a liquid ejection head for recording on a recording medium by ejecting liquid, such as ink, as well as a recording apparatus including the same, and in particular, to a liquid ejection head that performs inkjet printing and a recording apparatus including the same.

2. Description of the Related Art

An inkjet printhead (hereinafter referred to as a printhead) mounted on an inkjet recording apparatus includes a recording element substrate having ejection ports for ejecting ink droplets and a supply system for supplying the ink ejected from the ejection ports to the recording element substrate. Some of the printheads have a configuration in which the periphery of the recording element substrate is not surrounded by a wiring member, such as a flexible wiring member.

A printhead disclosed in Japanese Patent Laid-Open No. 2007-190907 has a configuration in which a rectangular recording element substrate 1100 and a wiring member 1300 are electrically connected at only one of the short sides, that is, at one side, of the recording element substrate 1100, as shown in FIG. 8A.

A printhead in which a recording element substrate and a wiring member are electrically connected at one side, as in Japanese Patent Laid-Open No. 2007-190907, is disclosed in PCT Japanese Translation Patent Publication No. 2005-506917. This print head has a member (cap shroud) for constituting a continuous surface with which a cap comes into contact.

A printhead disclosed in Japanese Patent Laid-Open No. 2002-254661 has a configuration in which the recording element substrate and the wiring member 1300 are electrically connected at long sides of the rectangular recording element substrate, as shown in FIG. 8B, and there is no need to surround the entire periphery of the recording element substrate with the wiring member 1300. However, a continuous surface with which a cap comes into contact is formed by providing the wiring member 1300 also at portions where the recording element substrate and the wiring member 1300 are not electrically connected.

In the case where the periphery of the recording element substrate is surrounded by the cap, as in the above, if the wiring member is disposed so as to surround the periphery of the recording element substrate, airtightness inside the cap can be held well.

However, in a printhead in which the recording element substrate and the wiring member are electrically connected at one side, as in the printhead disclosed in Japanese Patent Laid-Open No. 2007-190907, when the cap is brought into contact with the periphery of the recording element substrate, a gap is formed due to the level difference between the wiring member and a surface on which the wiring member is disposed, thus decreasing the airtightness.

Thus, a member that constitutes the continuous surface may be provided as disclosed in PCT Japanese Translation Patent Publication No. 2005-506917. However, this needs a process and an adhesive for joining the new member, thus increasing the cost.

A configuration in which the continuous surface is formed by providing the wiring member at a portion where the recording element substrate and the wiring member are not electrically connected is possible, as disclosed in Japanese Patent Laid-Open No. 2002-254661. However, this configuration needs the wiring member also at an unnecessary portion, thus increasing the cost.

SUMMARY OF THE INVENTION

The present invention provides a liquid ejection head including a liquid ejection substrate having ejection ports for electing liquid; a wiring member electrically connected to the liquid ejection substrate; and a surface including a reference surface, a mounting region for the liquid ejection substrate, and a recessed portion that is recessed relative to the reference surface, wherein the reference surface, the mounting region, and the recessed portion are next to one another, and the wiring member is disposed in the recessed portion.

With the above configuration, when a cap provided in the recording apparatus is brought into contact with the periphery of the liquid ejection substrate, the airtightness inside the cap that covers the liquid ejection substrate can be enhanced, thus allowing the evaporation of the liquid through the ejection ports to be reduced.

Further features of the present invention will become apparent from the following description of exemplary embodiments with reference to the attached drawings.

DESCRIPTION OF THE EMBODIMENTS

The basic configuration of an inkjet printhead (hereinafter referred to as a printhead), which is a liquid ejection head according to an embodiment of the present invention, will be described hereinbelow.

In this specification, "recording" indicates forming significant information, such as characters and figures, and expressing either significant or insignificant information so that humans can perceive it, and "recording" also includes forming images, designs, patterns, etc. on a recording medium and processing a recording medium.

"Recording medium" includes not only paper used in general recording apparatuses but also ink receptive media, such as cloth, plastic film, metal plates, glass, ceramics, wood, and leather.

"Ink" should be given a broad definition as the definition of "recording". Accordingly, "ink" indicates liquid that is put onto a recording medium to form images, designs, patterns, etc., to process the recording medium, or to process ink. Accordingly, "ink" includes all kinds of liquid that can be used for recording.

First Embodiment

Referring to FIGS. 1A to 1D, an inkjet printhead (hereinafter referred to as a printhead) H1000, which is a liquid ejection head according to an embodiment of the present invention, will be described.

Liquid Ejection Head

Figure 1A:
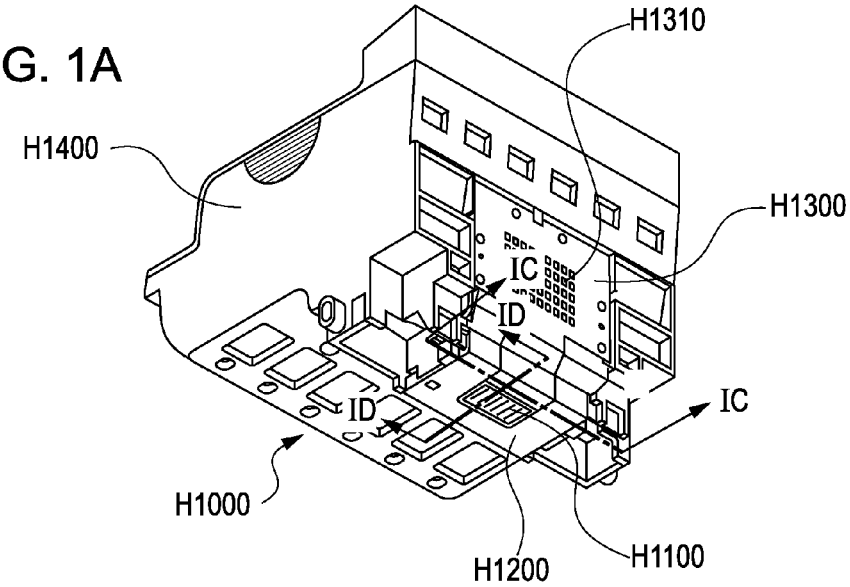
FIG. 1A is an explanatory diagram of a printhead according to a first embodiment.

As shown in FIG. 1A, the printhead H1000 includes a recording element substrate H1100 corresponding to a liquid ejection substrate; a wiring member H1300; and a housing H1400 for holding a tank for containing ink (not shown), the recording element substrate H1100, and the wiring member H1300.

Figure 6:
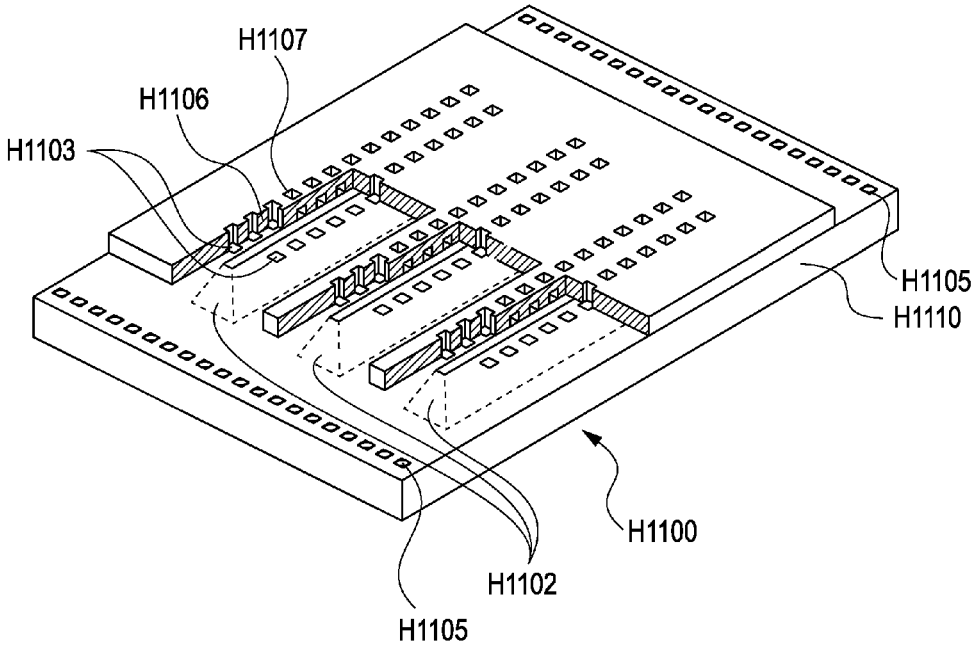
FIG. 6 is an explanatory diagram of a recording element substrate.

FIG. 6 is a partially cut-away perspective view for explaining the configuration of the recording element substrate H1100. The recording element substrate H1100 is constituted of a silicon substrate H1110 with a thickness of 0.5 mm to 1 mm and a passage forming member for forming passage walls H1106 that form ink flow passages, and ejection ports H1107.

The silicon substrate H1110 is provided with ink supply ports H1102 serving as through holes for supplying ink, formed by anisotropic etching or the like. Recording elements H1103 are provided on either side of the individual ink supply ports H1102 along the ink supply ports H1102. Examples of the recording elements H1103 are heating resistors and piezoelectric elements. Here, the heating resistor, such as a heater, will be described by way of example.

The silicon substrate H1110 is provided with electric wires (not shown) made of aluminum or the like for supplying electricity to the recording elements H1103 arranged in lines a predetermined distance from the ink supply ports H1102. The recording elements H1103 and the electric wires can be formed using an existing film growing technology (for example, a photolithography technology).

The silicon substrate H1110 is further provided with electrode portions constituted of a plurality of connecting terminals H1105 for supplying electricity to the electric wires and supplying electric signals for driving the recording elements H1103 along the sides at both ends of the array of the recording elements H1103. The connecting terminals H1105 are formed of bumps made of gold or the like.

The silicon substrate H1110 is provided with the passage forming member formed thereon by a photolithography technology. The passage forming member has ink flow passages corresponding to the recording elements H1103. The passage forming member has the ink flow passage walls H1106 that partition the individual ink flow passages and ceilings covering the tops thereof. The ceilings have the ejection ports H1107. The ejection ports H1107 are provided so as to face the individual recording elements H1103. The plurality of ejection ports H1107 are arranged to form the ejection port array.

In the thus-configured recording element substrate H1100, ink supplied through the ink supply ports H1102 due to the pressure of bubbles caused by heat generated from the recording elements H1103 is ejected through the ejection ports H1107 facing the recording elements H1103.

The wiring member H1300 is electrically connected to the recording element substrate H1100 to transmit electric signals and electricity from the exterior of the printhead H1000 (recording apparatus) to the recording element substrate H1100 in order to drive the recording elements H1103 provided on the recording element substrate H1100. Specifically, the connecting terminals H1105 formed at the ends on the surface of the recording element substrate H1100 and lead terminals at one end of wires formed on the wiring member H1300 are connected together by means of electrical connection, such as wire bonding. These electrically connecting portions are sealed by a sealant H1550 to prevent corrosion due to ink and damage due to an external force. A flexible printed wiring board, such as a flexible wiring board, is used as the wiring member H1300. The wiring member H1300 is bent to facilitate the electrical connection between the recording element substrate H1100 and the recording apparatus and is fixed to the housing H1400 of the printhead. The wiring member H1300 is formed such that a copper wire with a thickness of 40 μm is stacked on a 50-μm polyimide film (Upilex, manufactured by Ube Industries, Ltd.), on which styrene-butadiene rubber with a thickness of 70 μm is stacked as a protective film. The surface of the polyimide film is also coated with styrene-butadiene rubber with a thickness of 70 μm.

The printhead H1000 shown in FIG. 1A employs a flexible wiring board as the wiring member H1300, on which a plurality of connecting terminals H1310 for making electrical connection with the recording apparatus is provided. The plurality of connecting terminals H1310 may be disposed on a rigid wiring board, and the wiring member may be composed of the rigid wiring board and a flexible wiring board. In a case where the number of the connecting terminals H1310 is large, it is advantageous to use the rigid wiring member on which a plurality of wiring layers can easily be stacked. In a case where the number of the connecting terminals H1310 is small, it is advantages in terms of cost to use only the flexible wiring board as the wiring member H1300.

The housing H1400 of the printhead H1000 has a surface H1200 on which the recording element substrate H1100 and the wiring member H1300 are provided, with which a cap M5000, to be described later, comes into contact.

Recording Apparatus

Next, a recording apparatus that can incorporate a liquid ejection head according to an embodiment of the present invention can be mounted will be described with reference to FIG. 7.

Figure 7:
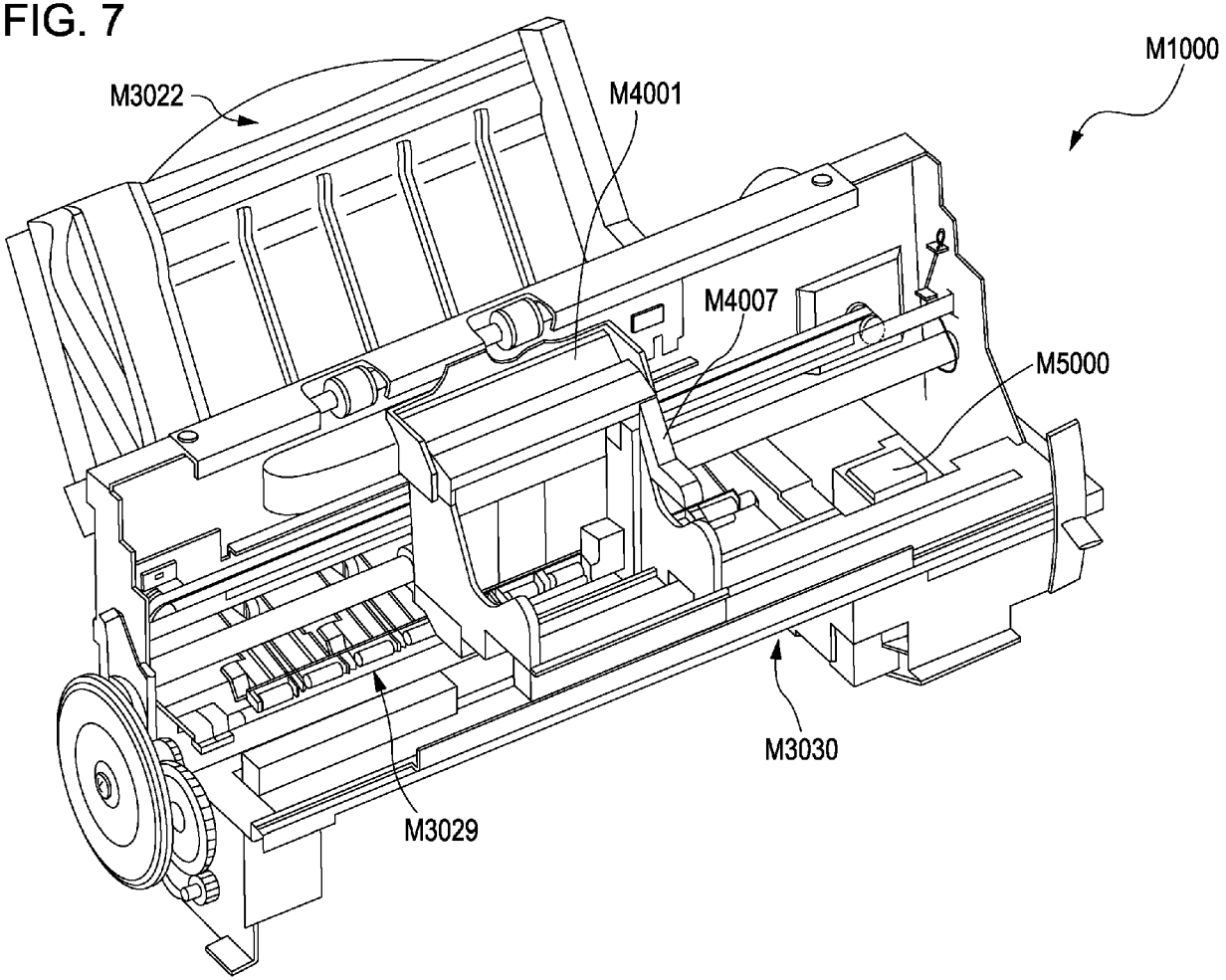
FIG. 7 is an explanatory diagram of a recording apparatus.
Figure 8A:
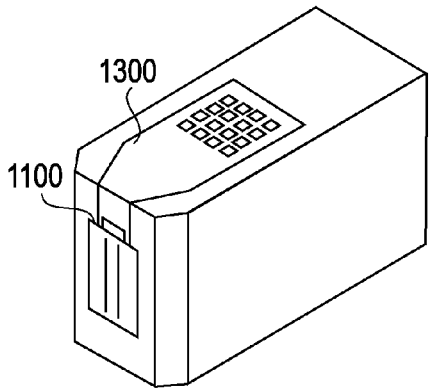
FIG. 8A is a diagram of a known printhead.
Figure 8B:
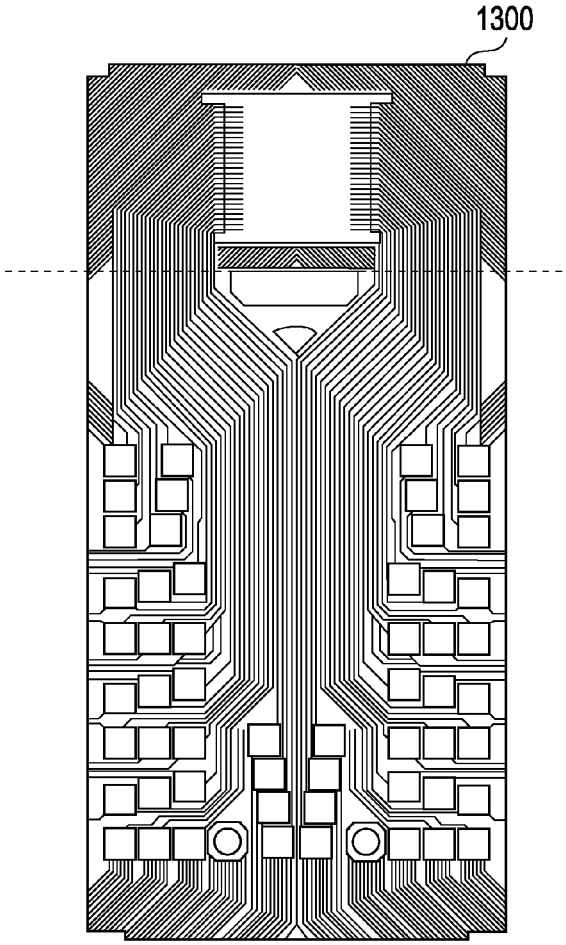
FIG. 8B is a diagram of a known wiring member.

FIG. 7 shows, in outline, the configuration of a recording apparatus M1000 that adopts an inkjet recording system and explains the recording mechanism of the recording apparatus M1000.

The recording apparatus M1000 includes an automatic feeding unit M3022 that automatically feeds a recording medium (not shown) into the apparatus main body and a conveying unit M3029 that conveys the recording medium from a recording position to an eject unit M3030.

The recording apparatus M1000 further includes the cap M5000 that seals the recording element substrate H1100 to prevent ink from evaporating through the ejection ports H1107 of the printhead H1000 and from being dried while printing is not performed. The recording apparatus M1000 further includes a mechanism for a recovery operation to ensure the reliability of ejection using the cap M5000.

The recording apparatus M1000 performs a recording operation by reciprocating a carriage M4001 on which the printhead H1000 is mounted.

Figure 1B:
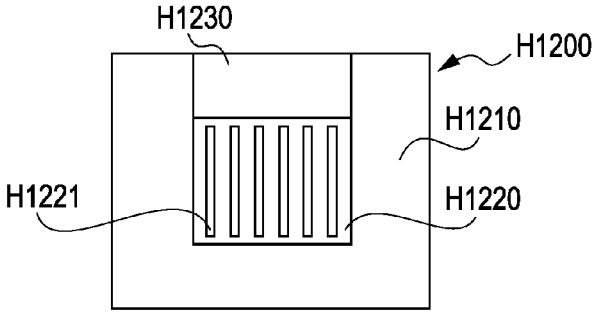
FIG. 1B is an explanatory diagram of the printhead according to the first embodiment.

Next, referring to FIGS. 1B to 1D, the surface H1200 with which the cap M5000 for preventing evaporation of ink through the ejection ports H1107 comes into contact will be described in detail. FIG. 1B is a diagram of the housing H1400 of the printhead H1000, shown in FIG. 1A, viewed from the side on which the recording element substrate H1100 is disposed.

The surface H1200 of the housing H1400 of the printhead H1000 includes a reference surface H1210, a mounting region H1220 on which the recording element substrate H1100 is to be mounted, and a recessed portion H1230 in which the wiring member H1300 is disposed. The mounting region H1220 is disposed next to the reference surface H1210 and the recessed portion H1230. That is, the printhead H1000 is configured such that the recording element substrate H1100 is next to the reference surface H1210 and the wiring member H1300. The mounting region H1220 is a portion of the outer surface of the housing H1400 of the printhead H1000. The wiring member H1300 is disposed on the other portion of the outer surface. The reference surface H1210 is a portion, except the other portion on which the wiring member H1300 is disposed, of the outer surface around the recording element substrate H1100.

Figure 1C:
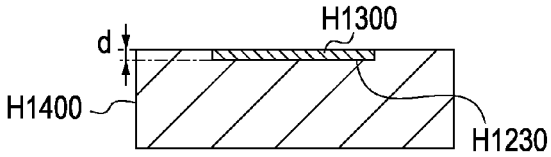
FIG. 1C is an explanatory diagram of the printhead according to the first embodiment.
Figure 1D:
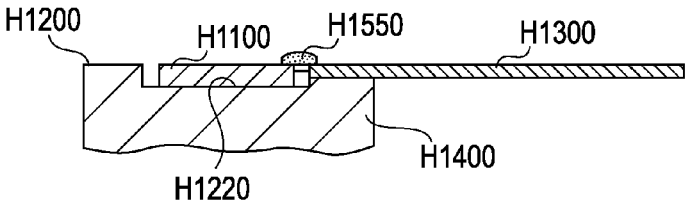
FIG. 1D is an explanatory diagram of the printhead according to the first embodiment.

The mounting region H1220 for the recording element substrate H1100 shown in FIG. 1B is recessed relative to the reference surface H1210, as shown in FIG. 1D. This is for the purpose of substantially aligning the electrode portions of the recording element substrate H1100 with the lead terminals of the wiring member H1300 in order to reduce stress exerted on the joint portion between the recording element substrate H1100 and the wiring member H1300. Thus, even if the mounting region H1220 is not recessed relative to the reference surface H1210, the recording element substrate H1100 and the wiring member H1300 can be connected. However, the amount of protrusion of the recording element substrate H1100 from the reference surface H1210 can be reduced more when the mounting region H1220 is recessed relative to the reference surface H1210. This can reduce the distance between the reference surface H1210 and the recording medium when a recording operation is performed with the printhead H1000 mounted on the recording apparatus M1000, thus contributing to a decrease in the size of the printhead H1000. Thus, it is preferable that the mounting region H1220 be recessed relative to the reference surface H1210. As shown in FIG. 1B, the mounting region H1220 has ink supply holes H1221 for supplying the ink supplied from the tank held in the housing H1400 of the printhead H1000 to the recording element substrate H1100.

The configuration for reducing the level difference between the surface of the wiring member H1300 and the reference surface H1210 will be described in more detail with reference to FIG. 1C. FIG. 1C is a cross-sectional view of the printhead H1000 taken along line IC-IC.

The recessed portion H1230 has a depth d corresponding to the thickness of the wiring member H1300, with respect to the reference surface H1210. In this embodiment, the depth d is about 230 μm. Integrally molding the recessed portion H1230 and the resin housing H1400 can eliminates the process for forming the recessed portion H1230.

Joining the region of the wiring member H1300 mounted on the recessed portion H1230 to the recessed portion H1230, with an adhesive layer therebetween, can prevent the flexible wiring board from rising from the recessed portion H1230, as compared with a case in which they are not joined. In the case where the wiring member H1300 is connected to the recessed portion H1230, with the adhesive layer therebetween, the depth of the recessed portion H1230 should be adjusted to the sum of the thickness of the wiring member H1300 and the thickness of the adhesive layer. The wiring member H1300 and the surface H1200 of the housing H1400 were bonded using an epoxy adhesive (TNP0015A, manufactured by Kyocera Chemical Corporation).

Figure 2A:
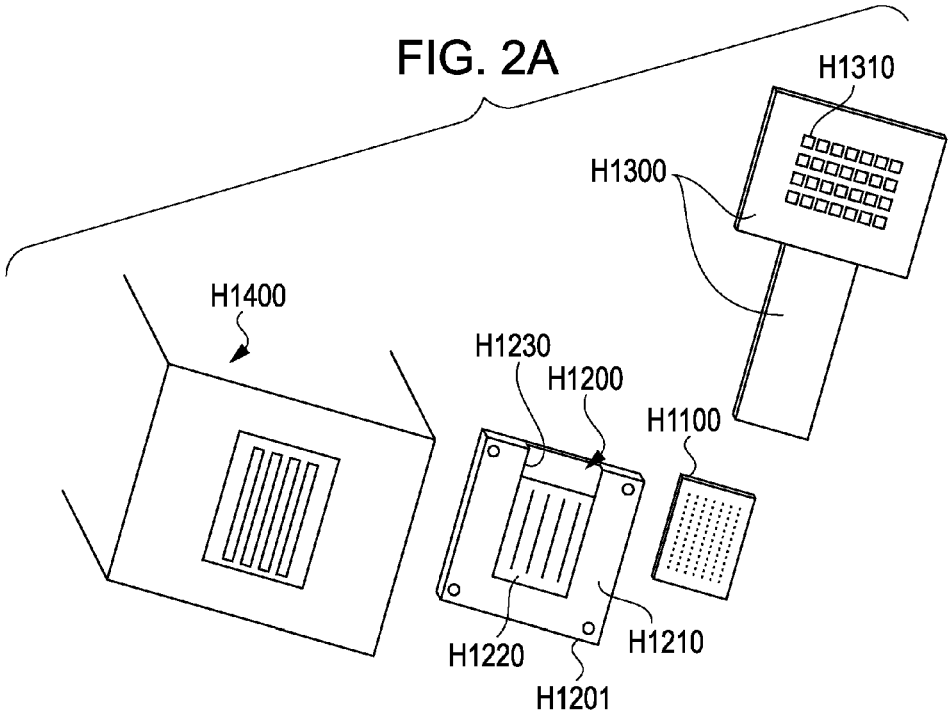
FIG. 2A is a diagram showing another configuration of the printhead of the first embodiment.

In this embodiment, the surface on which the recording element substrate H1100 is mounted is the surface H1200 of the housing H1400; alternatively, as shown in FIG. 2A, a support substrate H1201 for supporting the recording element substrate H1100 may be provide between the housing H1400 and the recording element substrate H1100. That is, the support substrate H1201 constitutes the surface H1200 of the housing H1400 of the printhead H1000 and includes the reference surface H1210, the mounting region H1220, and the recessed portion H1230.

Here, the support substrate H1201 is used to hold and fix the recording element substrate H1100 and wiring member H1300 and is formed of, for example, an alumina material ($Al_2O_3$) with a thickness of 0.5 mm to 10 mm. The material of the support substrate H1201 is not limited to alumina provided that it has a low linear expansion coefficient and high rigidity. Examples of the material of the support substrate H1201 are silicon (Si), aluminum nitride (AlN), zirconia ($ZrO_2$), silicon nitride ($Si_3N_4$), silicon carbide (SiC), molybdenum (Mo), and tungsten (W).

A method for forming the recessed portion H1230 in the support substrate H1201 may be any of integral molding, grinding, etc.

Figure 2B:
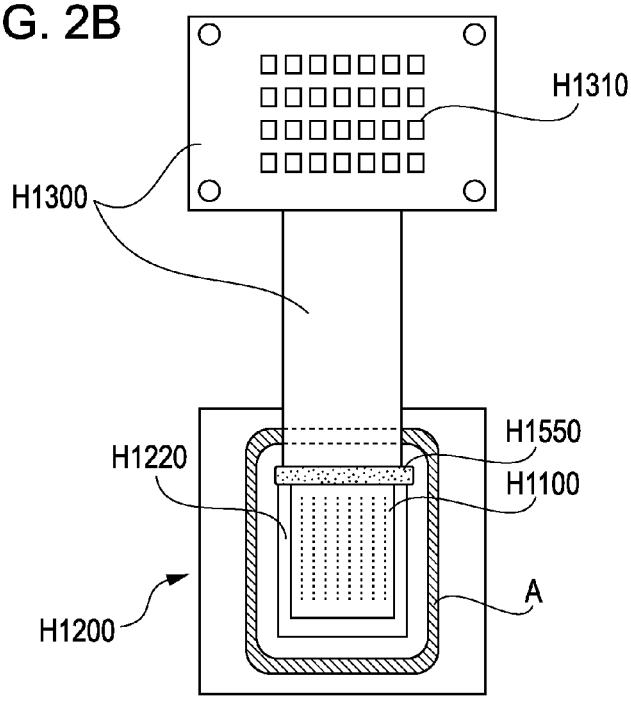
FIG. 2B is a diagram showing another configuration of the printhead of the first embodiment.

In this way, providing the recessed portion H1230 having a depth corresponding to the thickness of the wiring member H1300 in the surface H1200 of the housing H1400 and disposing the wiring member H1300 in the recessed portion H1230 allow the level difference between the surface of the wiring member H1300 and the reference surface H1210 to be decreased. This can enhance the airtightness inside the cap M5000 when the cap M5000 is brought into contact, of the surface H1200 of the housing H1400, at the periphery (contact region A in FIG. 2B) of the recording element substrate H1100, thereby allowing evaporation of ink through the ejection ports to be prevented. Furthermore, since the reference surface H1210 and the surface of the wiring member H1300 are placed substantially flush with each other, the advantages of the present invention can be increased.

The present invention can be applied to a configuration in which the boundary between the reference surface H1210 and the wiring member H1300 is present in the contact region A in the surface H1200 of the housing H1400, with which the cap M5000 comes into contact around the recording element substrate H1100. The present invention can be applied to the wiring members H1300 of the shapes shown in FIGS. 3A to 3C and can offer the advantage of enhancing the airtightness inside the cap M5000.

Figure 3A:
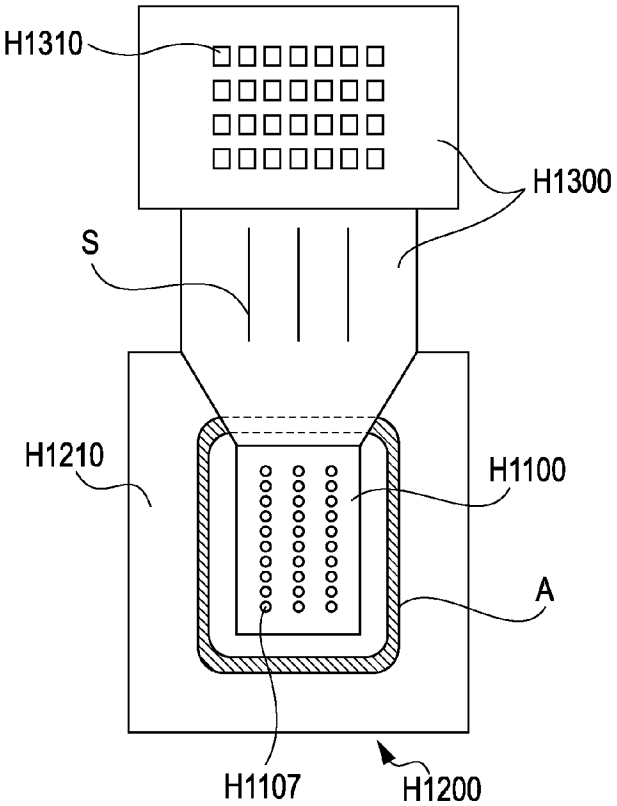
FIG. 3A is a diagram showing another configuration of the printhead of the first embodiment.

The configuration shown in FIG. 3A is a configuration in which the recording element substrate H1100 is rectangular and is electrically connected to the wiring member H1300 at one side of the recording element substrate H1100 (in FIG. 3A, one short side of the recording element substrate H1100) perpendicular to the array of the ejection ports H1107. This configuration can reduce the area of the wiring member H1300, thus reducing the cost of manufacturing the liquid ejection head.

As shown in FIG. 3A, the wiring member H1300 is tapered on the surface H1200 of the housing H1400. That is, the wiring member H1300 has a portion that increases in width in a direction in which the wires disposed on the wiring member H1300 extend from the portion electrically connected to the recording element substrate H1100 toward the connecting terminals H1310 that electrically connect to the recording apparatus. This configuration in which the wiring member H1300 has a tapered portion can increase the joint area at which the wiring member H1300 and the recessed portion H1230 in the surface H1200 of the housing H1400 are joined together. This increases the joining strength, thus preventing the wiring member H1300 from rising from the recessed portion H1230, and reducing the level difference between the surface of the wiring member H1300 and the reference surface H1210. Furthermore, this configuration can increase the area for the wires as compared with the configuration shown in FIG. 2B etc., thus increasing the flexibility of wiring layout.

Furthermore, as shown in FIG. 3A, by forming cuts S in the bendable wiring member H1300, the rigidity of the wiring member H1300 can be decreased. This can reduce the force of the wiring member H1300 to come off from the recessed portion H1230 or the force to rise from the recessed portion H1230. Therefore, the airtightness inside the cap M5000 that comes into contact with the surface H1200 of the housing H1400 can be enhanced.

Figure 3B:
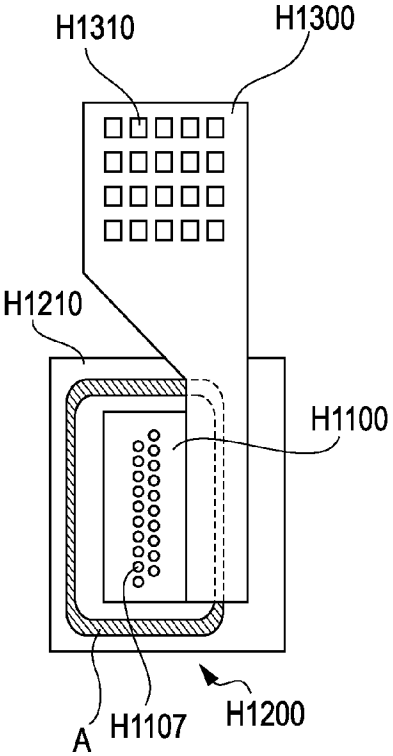
FIG. 3B is a diagram showing another configuration of the printhead of the first embodiment.

The configuration shown in FIG. 3B is a configuration in which the recording element substrate H1100 is rectangular and is electrically connected to the wiring member H1300 at one side of the recording element substrate H1100 (in FIG. 3B, a long side of the recording element substrate H1100) along the array of the ejection ports H1107.

Figure 3C:
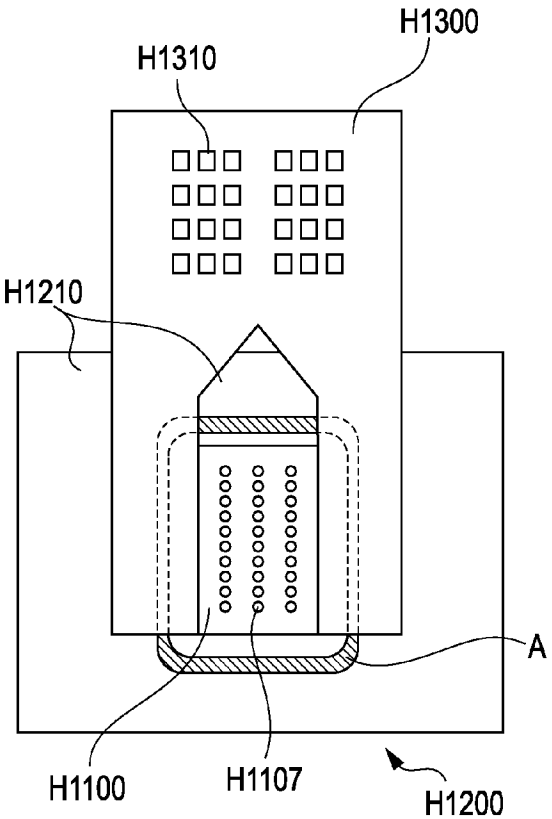
FIG. 3C is a diagram showing another configuration of the printhead of the first embodiment.

The configuration shown in FIG. 3C is a configuration in which the recording element substrate H1100 is rectangular and is electrically connected to the wiring member H1300 at two sides of the recording element substrate H1100 (in FIG. 3C, both long sides of the recording element substrate H1100) along the array of the ejection ports H1107. With such a configuration, the wiring member H1300 and the recording element substrate H1100 are electrically connected at the two sides. This is therefore advantageous in a case where the number of the connecting terminals H1310 that electrically connect to the recording apparatus is large. The portion enclosed by the recording element substrate H1100 and the wiring member H1300 in FIG. 3C may be provided with the wiring member H1300 in the recessed portion H1230. In this case, the wiring member H1300 and the recording element substrate H1100 are electrically connected at three sides, which is more advantageous in the case where the number of the connecting terminals H1310 that electrically connect to the recording apparatus is large. The configuration in FIG. 3C provides high joining strength when joining the wiring member H1300 and the recessed portion H1230 because the joining area is large, thus preventing the wiring member H1300 from rising from the recessed portion H1230. This can therefore reduce the level difference between the surface of the wiring member H1300 and the reference surface H1210.

While this embodiment has been described when applied to a configuration in which the tank is detachable from the housing H1400 of the printhead H1000, the present invention can also be applied to a configuration in which the housing H1400 of the printhead H1000 and the tank are integrated and can offer the same advantages as those of the above-described configuration.

Second Embodiment

A second embodiment of the present invention will be described with reference to FIGS. 4A to 4C.

Figure 4A:
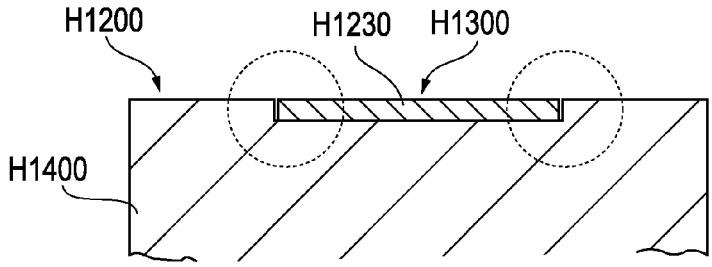
FIG. 4A is an explanatory diagram of a printhead according to a second embodiment.

FIG. 4A is a cross-sectional view corresponding to FIG. 1C of the first embodiment; FIG. 4B is an enlarged view of the gap between the wiring member H1300 and the recessed portion H1230 in FIG. 4A. FIG. 4C is a diagram showing a state in which the cap M5000 is in contact with the surface H1200 of the housing H1400.

Components with the same configurations as in the first embodiment are given the same reference numerals and descriptions thereof will be omitted.

The second embodiment is characterized in that a rubber elastic member H1500 fills the gap between the wiring member H1300 and the recessed portion H1230, in addition to the configuration of the first embodiment. This configuration can decrease the gap formed between the wiring member H1300 the recessed portion H1230 when the cap M5000 is brought into contact with the periphery of the recording element substrate H1100 as compared with the configuration of the first embodiment.

Figure 4B:
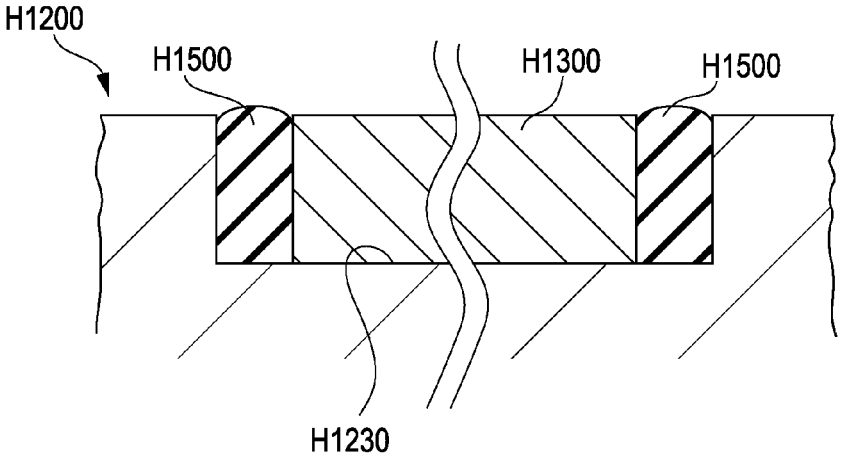
FIG. 4B is an explanatory diagram of the printhead according to the second embodiment.
Figure 4C:
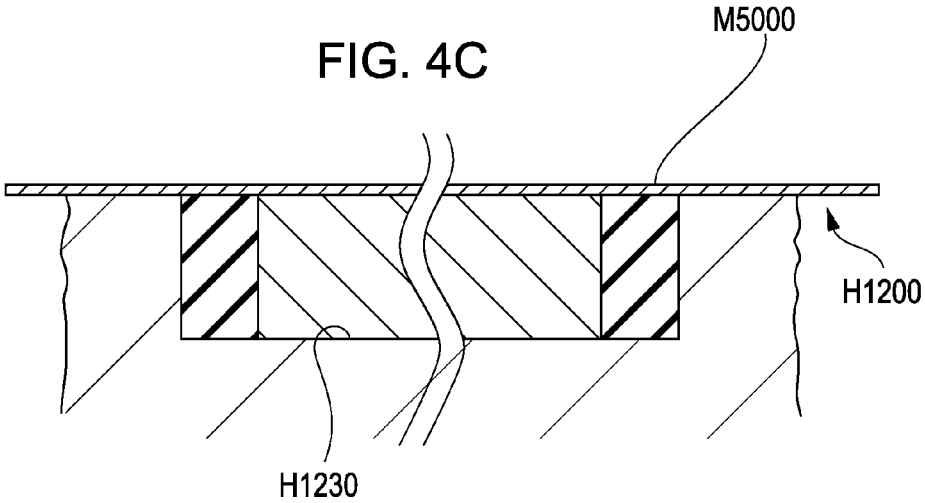
FIG. 4C is an explanatory diagram of the printhead according to the second embodiment.

Furthermore, as shown in FIG. 4B, the elastic member H1500 protrudes from the surface of the wiring member H1300 and the reference surface H1210. This configuration allows the rubber elastic member H1500 to be deformed to fill the gap between the wiring member H1300 and the recessed portion when the cap M5000 is brought into contact with the periphery of the recording element substrate H1100, as shown in FIG. 4C. This can further enhance the airtightness inside the cap M5000 as compared with the above configuration in which the elastic member H1500 is merely charged.

Third Embodiment

A third embodiment of the present invention will be described with reference to FIGS. 5A to 5C.

Figure 5A:
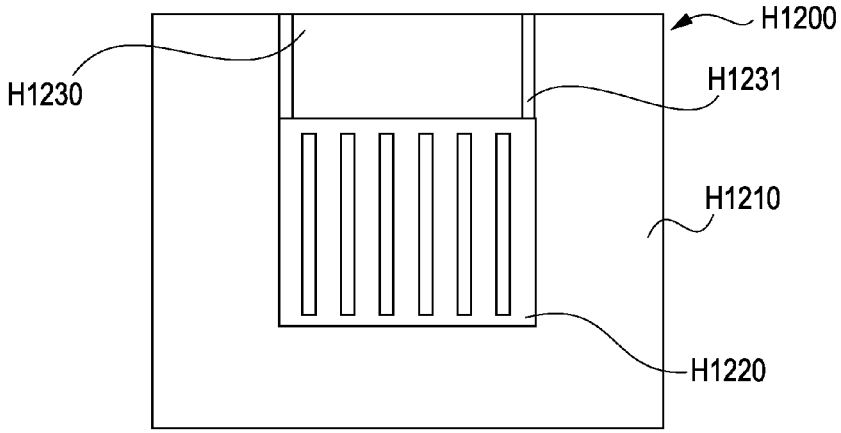
FIG. 5A is an explanatory diagram of a printhead according to a third embodiment.

FIG. 5A corresponds to FIG. 1B of the first embodiment; FIG. 5B corresponds to FIG. 4B, showing an enlarged view of the gap between the wiring member H1300 and the recessed portion H1230; and FIG. 5C is a diagram showing a state in which the cap M5000 is in contact with the surface H1200 of the housing H1400.

Components with the same configurations as in the first and second embodiments are given the same reference numerals and descriptions thereof will be omitted.

Figure 5B:
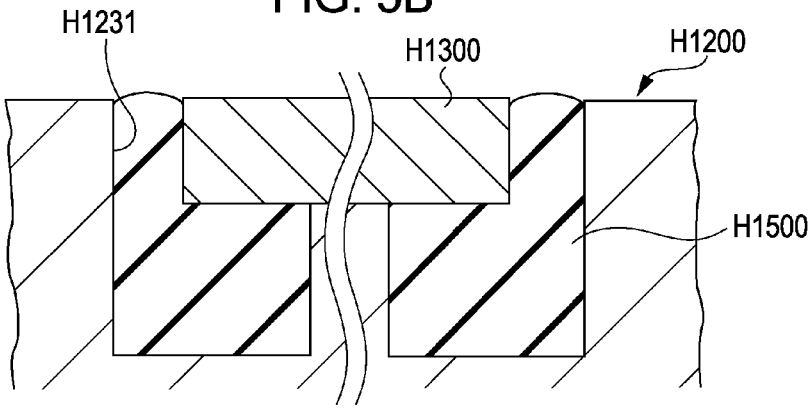
FIG. 5B is an explanatory diagram of the printhead according to the third embodiment.
Figure 5C:
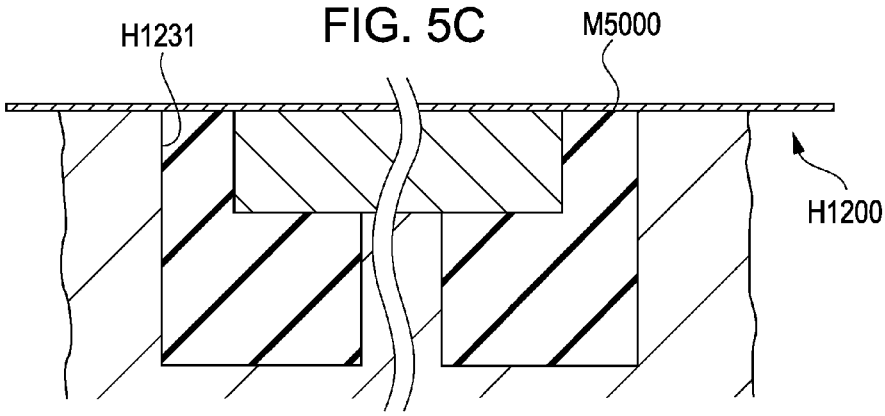
FIG. 5C is an explanatory diagram of the printhead according to the third embodiment.

As shown in FIGS. 5A and 5B, the third embodiment is configured such that the recessed portion H1230 has grooves H1231 along the boundaries with the reference surface H1210, and the grooves H1231 are filled with the rubber elastic member H1500, in addition to the configuration of the second embodiment. As shown in FIG. 5C, this configuration allows the portions of the wiring member H1300 corresponding to the grooves H1231 to deflect more freely than the configuration of the second embodiment when the cap M5000 is brought into contact with the periphery of the recording element substrate H1100. This can further reduce the gap formed between the wiring member H1300 and the recessed portion H1230 as compared with the configuration of the second embodiment, thereby further enhancing the airtightness inside the cap M5000. Furthermore, since the portions of the wiring member H1300 corresponding to the grooves H1231 can deflect when the cap M5000 comes into contact with the periphery of the recording element substrate H1100, the airtightness in the gap M5000 can be maintained even if the surface of the wiring member H1300 is higher than the reference surface H1210. Thus, with the configuration of the third embodiment, the accuracy of the recessed portion H1230 may be lower than that in the firsts and second embodiments, and thus the printhead H1000 can be manufactured at lower cost.

As described with reference to the first to third embodiments, the printhead H1000 incorporating the present invention is configured such that the gap between the cap M5000 and the surface of the housing H1400 can be small when the cap M5000 is brought into contact with the periphery of the recording element substrate H1100, so that the airtightness inside the cap M5000 can be enhanced. Accordingly, evaporation of the ink through the ejection ports H1107 of the recording element substrate H1100 when the periphery of the recording element substrate H1100 is sealed with the cap M5000 while printing is not performed can be prevented. Thus, even if a recording operation is performed after the recording element substrate H1100 is sealed by the cap M5000, good printing can be performed.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-324175 filed on Dec. 19, 2008, which is hereby incorporated by reference herein in its entirety.

What is claimed is:

1. A liquid ejection head comprising:

a housing having an outer surface, the outer surface having a first portion, a second portion, and a third portion, the first portion being adjacent to both the second and third portions;

a liquid ejection substrate disposed at the first portion and having ejection ports for ejecting liquid;

a wiring member disposed on a recessed surface defined by the second portion so as to electrically connected to the liquid ejection substrate along a longitudinal side of the liquid ejection substrate; and wherein the ejection ports are covered by a cap that is in contact with the wiring member and the third portion around the liquid ejection substrate.

2. The liquid ejection head according to claim 1, further comprising a rubber elastic member that fills a gap between the wiring member and the portion, except the second portion, of the first outer surface around the liquid ejection substrate.

3. The liquid ejection head according to claim 2, wherein on the first outer surface, the elastic member protrudes from a surface of the wiring member and the portion, except the second portion, of the first outer surface around the liquid ejection substrate.

4. The liquid ejection head according to claim 2, wherein the second portion of the first outer surface has grooves along boundaries with the portion, except the second portion, of the first outer surface around the liquid ejection substrate, and the grooves are filled with a rubber elastic member.

5. The liquid ejection head according to claim 4, wherein the surface of the wiring member is higher than the portion, except the second portion, of the first outer surface around the liquid ejection substrate.

6. The liquid ejection head according to claim 1, wherein the third portion and a surface of the wiring member are flush with each other.

7. The liquid ejection head according to claim 1, wherein the wiring member is joined to the second portion of the outer surface.

8. The liquid ejection head according to claim 1, further comprising:

a connecting terminal allowing electrically connecting to a recording apparatus on another outer surface different from the outer surface on which the liquid ejection substrate is disposed, wherein the wiring member is disposed on the another outer surface to electrically connect to the connecting terminal and is bent along a corner formed by the another outer surface and the outer surface on which the liquid ejection substrate is disposed.

9. The liquid ejection head according to claim 8, wherein the wiring member has a portion that increases in width in a direction in which wires disposed on the wiring member extend from the third portion at which electrical connection with the liquid ejection substrate is made toward the connecting terminal.

10. The liquid ejection head according to claim 8, wherein the wiring member has a cut in a direction in which wires disposed on the wiring member extend from the third portion at which electrical connection with the liquid ejection substrate is made toward the connecting terminals.

11. A recording apparatus comprising:

the liquid ejection head according to claim 1; and the cap.

12. A recording apparatus comprising a liquid ejection head, the liquid ejection head comprising:

a housing having an outer surface, the outer surface having a first portion, a second portion, and a third portion, the first portion being adjacent to both the second and third portions;

a liquid ejection substrate disposed at the first portion and having a plurality of ejection ports for ejecting liquid;

a wiring member disposed on a recessed surface defined by the second portion so as to electrically connected to the liquid ejection substrate;

wherein the ejection ports are covered by a cap that is in contact with the wiring member and the third portion around the liquid ejection substrate; and the wiring member having at least one tapered portion to increase a contact area between the wiring member and the recessed surface.

13. A recording apparatus comprising a liquid ejection head, the liquid ejection head comprising:

a housing having an outer surface, the outer surface having a first portion, a second portion, and a third portion, the first portion being adjacent to both the second and third portions;

a liquid ejection substrate disposed at the first portion of the outer surface and having a plurality of ejection ports for ejecting liquid;

a wiring member having a first portion disposed on a recessed surface defined by the second portion of the outer surface so as to electrically connected to the liquid ejection substrate, a second portion comprising a plurality of connecting terminals formed thereon, and a third portion extending between the first and third portions;

wherein the ejection ports are covered by a cap that is in contact with the wiring member and the third portion around the liquid ejection substrate; and the third portion of the wiring member comprising at least one cut to increase flexibility thereof.

14. A recording apparatus comprising a liquid ejection head, the liquid ejection head comprising:

a housing having an outer surface, the outer surface having a first portion, a second portion, and a third portion, the first portion being adjacent to both the second and third portions;

a liquid ejection substrate disposed at the first portion of the outer surface and having a plurality of ejection ports for ejecting liquid;

a wiring member having a first portion disposed on a recessed surface defined by the second portion of the outer surface so as to electrically connected to the liquid ejection substrate, a second portion comprising a plurality of connecting terminals formed thereon, and a third portion extending between the first and third portions;

wherein the ejection ports are covered by a cap that is in contact with the wiring member and the third portion around the liquid ejection substrate; and the second portion of the wiring member having a flexibility depending on a number of the connecting terminals formed thereon.

* * * * *